US008744106B2

(12) United States Patent
Ball

(10) Patent No.: US 8,744,106 B2
(45) Date of Patent: Jun. 3, 2014

(54) MRI SAFE ACTUATOR FOR IMPLANTABLE FLOATING MASS TRANSDUCER

(75) Inventor: Geoffrey R. Ball, Axams (AT)

(73) Assignee: Vibrant Med-El Hearing Technology GmbH, Innsbruck (AT)

( * ) Notice: Subject to any disclaimer, the term of this patent is extended or adjusted under 35 U.S.C. 154(b) by 164 days.

(21) Appl. No.: 13/403,062

(22) Filed: Feb. 23, 2012

(65) Prior Publication Data

US 2012/0219166 A1 Aug. 30, 2012

Related U.S. Application Data

(60) Provisional application No. 61/446,279, filed on Feb. 24, 2011.

(51) Int. Cl.
*H04R 25/00* (2006.01)

(52) U.S. Cl.
USPC ..... 381/326; 381/312; 381/151

(58) Field of Classification Search
USPC ..... 381/151, 190, 312, 326, 380; 600/25; 607/55–57
See application file for complete search history.

(56) References Cited

U.S. PATENT DOCUMENTS

| | | | | |
|---|---|---|---|---|
| 5,800,336 | A | 9/1998 | Ball et al. | 600/25 |
| 5,897,486 | A | 4/1999 | Ball et al. | 600/25 |
| 2010/0145135 | A1 | 6/2010 | Ball et al. | 600/25 |
| 2011/0022120 | A1 * | 1/2011 | Ball et al. | 607/57 |

FOREIGN PATENT DOCUMENTS

| | | |
|---|---|---|
| EP | 2031896 A2 | 3/2009 |

OTHER PUBLICATIONS

European Patent Office, Officer Stephanie Lins, International Search Report and Written Opinion, PCT/US2012/026238, date of mailing Jul. 4, 2012, 12 pages.

* cited by examiner

*Primary Examiner* — Matthew Eason

(74) *Attorney, Agent, or Firm* — Sunstein Kann Murphy & Timbers LLP

(57) ABSTRACT

A floating mass transducer for a hearing implant includes a cylindrical transducer housing that is attachable to a middle ear hearing structure and that has an outer surface with one or more electric drive coils thereon. A cylindrical transducer magnet arrangement is positioned within an interior volume of the transducer housing and includes a magnetic pair of an inner rod magnet and an outer annular magnet. Current flow through the drive coils creates a coil magnetic field that interacts with the magnetic fields of the transducer magnet arrangement to create vibration in the transducer magnet which is coupled by the transducer housing to the middle ear hearing structure for perception as sound. Opposing magnetic fields of the transducer magnet arrangement cancel each other to minimize their combined magnetic field and thereby minimize magnetic interaction of the transducer magnet arrangement with any external magnetic field.

6 Claims, 6 Drawing Sheets

MRI SAFE ACTUATOR FOR IMPLANTABLE FLOATING MASS TRANSDUCER

This application claims priority from U.S. Provisional Patent Application 61/446,279, filed Feb. 24, 2011, which is incorporated herein by reference.

TECHNICAL FIELD

The present invention relates to hearing implant systems and using such systems in the presence of external magnetic fields such as for magnetic resonance imaging.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window and round window membranes of the cochlea 104. The cochlea 104 is a long narrow organ wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the acoustic nerve 113 reside. In response to received sounds transmitted by the middle ear 103, the fluid-filled cochlea 104 functions as a transducer to generate electric pulses which are transmitted to the cochlear nerve 113, and ultimately to the brain.

Hearing is impaired when there are problems in the ability to transduce external sounds into meaningful action potentials along the neural substrate of the cochlea 104. To improve impaired hearing, various types of hearing prostheses have been developed. For example, when hearing impairment is associated with the cochlea 104, a cochlear implant with an implanted stimulation electrode can electrically stimulate auditory nerve tissue within the cochlea 104 with small currents delivered by multiple electrode contacts distributed along the electrode.

When a hearing impairment is related to the operation of the middle ear 103, a conventional hearing aid or a middle ear implant (MEI) device may be used to provide acoustic-mechanical vibration to the auditory system. FIG. 1 also shows some components in a typical MEI arrangement where an external audio processor 100 processes ambient sounds to produce an implant communications signal that is transmitted through the skin to an implanted receiver 102. Receiver 102 includes a receiver coil that transcutaneously receives signals the implant communications signal which is then demodulated into a transducer stimulation signals which is sent over leads 106 through a surgically created channel in the temporal bone to a floating mass transducer (FMT) 104 in the middle ear. The transducer stimulation signals cause drive coils within the FMT 104 to generate varying magnetic fields which in turn vibrate a magnetic mass suspending within the FMT 104. The vibration of the inertial mass of the magnet within the FMT 104 creates vibration of the housing of the FMT 104 relative to the magnet. And since the FMT 104 is connected to the incus, it then vibrates in response to the vibration of the FMT 104 which is perceived by the user as sound.

Besides the inertial mass magnet within an FMT, some hearing implants such as Middle Ear Implants (MEI's) and Cochlear Implants (CI's) also employ attachment magnets in the implantable part and an external part to hold the external part magnetically in place over the implant. For example, as shown in FIG. 2, a typical MEI system may include an external transmitter housing 201 containing transmitting coils 202 and an external magnet 203. The external magnet 203 has a conventional disk-shape and a north-south magnetic dipole that is perpendicular to the skin of the patient to produce external magnetic field lines 204 as shown. Implanted under the patient's skin is a corresponding receiver assembly 205 having similar receiving coils 206 and an implanted internal magnet 207. The internal magnet 207 also has a disk-shape and a north-south magnetic dipole that is perpendicular to the skin of the patient to produce internal magnetic field lines 208 as shown. The internal receiver housing 205 is surgically implanted and fixed in place within the patient's body. The external transmitter housing 201 is placed in proper position over the skin covering the internal receiver assembly 205 and held in place by interaction between the internal magnetic field lines 208 and the external magnetic field lines 204. Rf signals from the transmitter coils 202 couple data and/or power to the receiving coil 206 which is in communication with the implanted MEI transducer (e.g., the FMT, not shown).

A problem arises when a patient with a hearing implant undergoes Magnetic Resonance Imaging (MRI) examination. Interactions occur between the implant magnet(s) and the applied external magnetic field for the MRI. As shown in FIG. 3, the direction magnetization $\vec{m}$ of the implant magnet 302 is essentially perpendicular to the skin of the patient. Thus, the external magnetic field $\vec{B}$ from the MRI may create a torque $\vec{T}$ on the internal magnet 302, which may displace the internal magnet 302 or the whole implant housing 301 out of proper position. Among other things, this may damage the adjacent tissue in the patient. In addition, the external magnetic field $\vec{B}$ from the MRI may reduce or remove the magnetization $\vec{m}$ of the implant magnet 302 so that it may no longer be strong enough to hold the external transmitter housing in proper position. The implant magnet 302 may also cause imaging artifacts in the MRI image, there may be induced voltages in the receiving coil, and hearing artifacts due to the interaction of the external magnetic field $\vec{B}$ of the MRI with the implanted device. This is especially an issue with MRI field strengths exceeding 1.5 Tesla.

Thus, for existing implant systems with magnet arrangements, it is common to either not permit MRI or at most limit use of MRI to lower field strengths. Other existing solutions include use of a surgically removable magnets, spherical implant magnets (e.g. U.S. Pat. No. 7,566,296), and various ring magnet designs (e.g., U.S. Provisional Patent 61/227,632, filed Jul. 22, 2009). Among those solutions that do not require surgery to remove the magnet, the spherical magnet design may be the most convenient and safest option for MRI removal even at very high field strengths. But the spherical magnet arrangement requires a relatively large magnet much larger than the thickness of the other components of the implant, thereby increasing the volume occupied by the implant. This in turn can create its own problems. For example, some systems, such as cochlear implants, are implanted between the skin and underlying bone. The "spherical bump" of the magnet housing therefore requires preparing a recess into the underlying bone. This is an additional step during implantation in such applications which can be very challenging or even impossible in case of very young children.

SUMMARY

Embodiments of the present invention are directed to a floating mass transducer for a hearing implant. A cylindrical transducer housing is attachable to a middle ear hearing structure and has an outer surface with one or more electric drive coils thereon. A cylindrical transducer magnet arrangement is positioned within an interior volume of the transducer housing and includes a magnetic pair of: i. an inner rod magnet disposed along the cylinder axis with a first magnetic field direction, and ii. an outer annular magnet surrounding the inner rod magnet along the cylinder axis with a second magnetic field direction opposite to the first magnetic field direction. Current flow through the drive coils creates a coil magnetic field that interacts with the magnetic fields of the transducer magnet arrangement to create vibration in the transducer magnet which is coupled by the transducer housing to the middle ear hearing structure for perception as sound. In addition, the opposing magnetic fields of the transducer magnet arrangement cancel each other to minimize their combined magnetic field and thereby minimize magnetic interaction of the transducer magnet arrangement with any external magnetic field.

The transducer magnet arrangement may include multiple magnetic pairs positioned end to end. These may be mechanically held against each other and meet with like magnetic polarities that repel each other. For example, there may be a magnet adhesive mechanically holding the magnetic pairs against each other, and/or a magnet holding tube containing the magnetic pairs and mechanically holding them against each other, and/or a pair of magnet springs, one at each end of the transducer magnet arrangement to: i. mechanically hold the magnetic pairs against each other, ii. suspend the transducer magnet arrangement within the transducer housing, and iii. transfer vibration of the transducer magnet arrangement to the transducer housing. Or the magnetic pairs may meet with opposing magnetic polarities that attract each other to magnetically hold them against each other. In any of these there may be multiple electric drive coils.

DETAILED DESCRIPTION

To date, the issue of torque on implant magnets from MRI fields has dealt mainly with the attachment magnets. They are an order of magnitude larger than the inertial mass magnet in an FMT, so perhaps it is not surprising that prior efforts have not specifically addressed MRI field torque on FMT inertial mass magnets. Even so, MRI field torque on the inertial mass magnet can damage the FMT.

Figure 1:
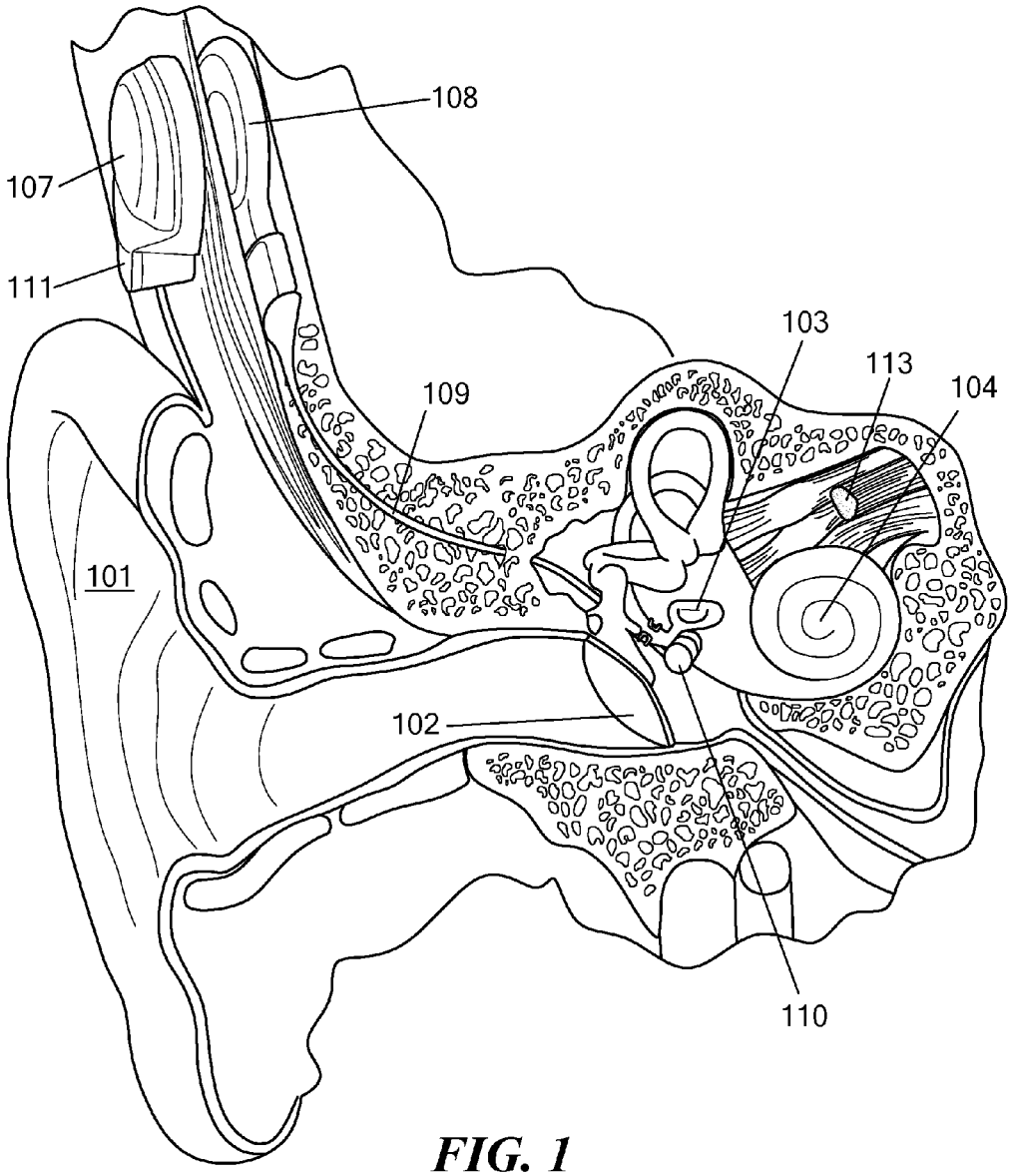
FIG. 1 shows some components in a typical middle ear implant arrangement in the ear of a patient user.
Figure 2:
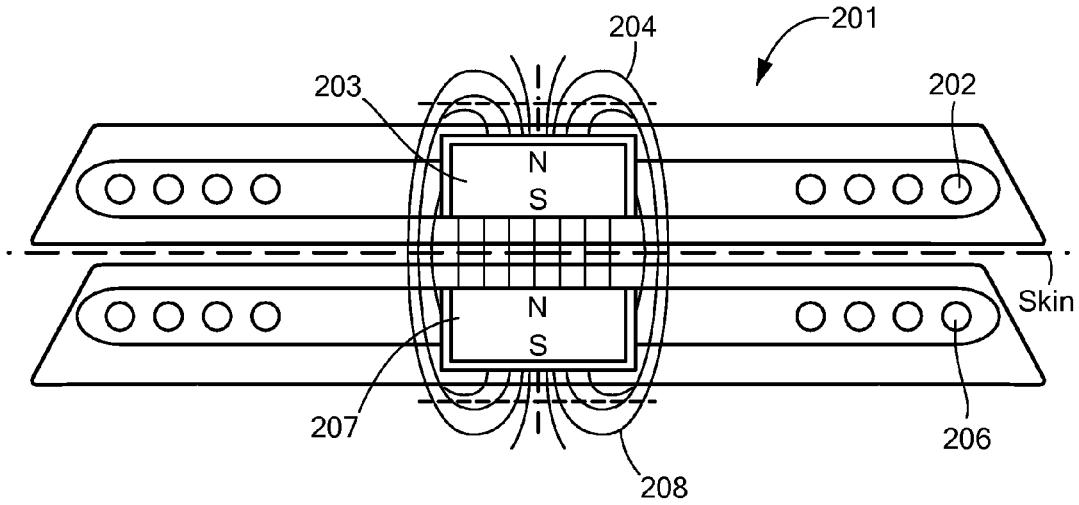
FIG. 2 illustrates the signal coil arrangement in a typical middle ear implant system.
Figure 3:
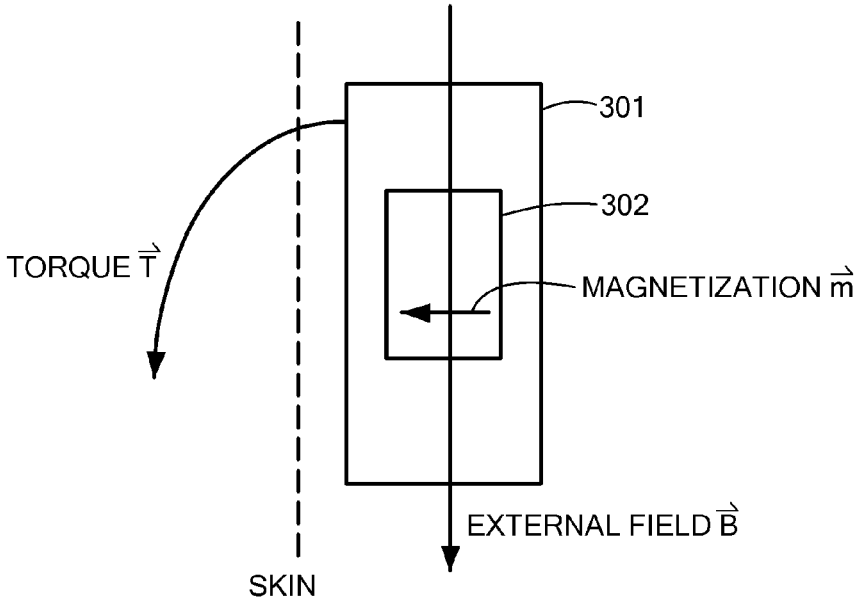
FIG. 3 illustrates the magnetic torque exerted on an implant magnet by an external magnetic field.
Figure 4:
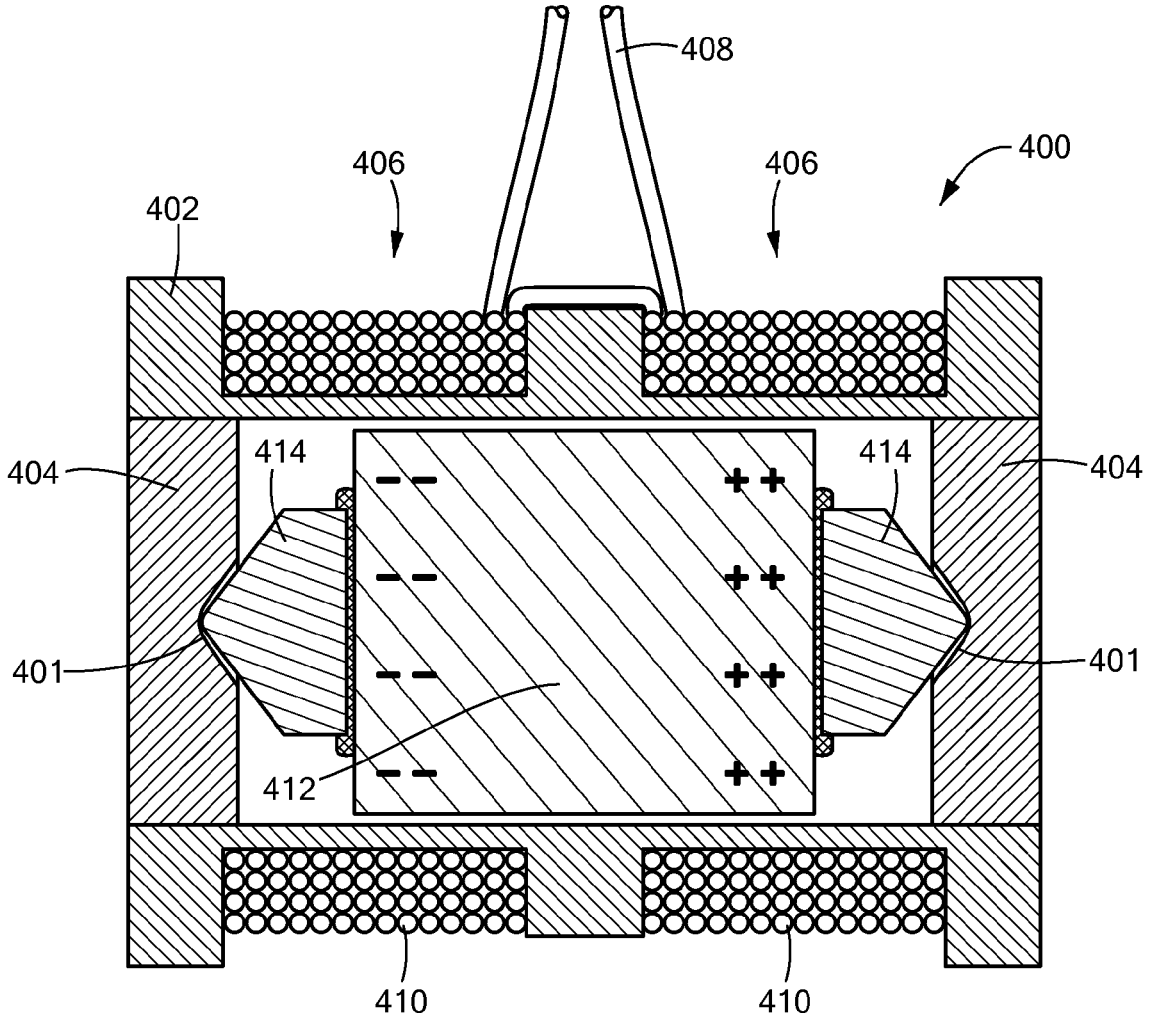
FIG. 4 (PRIOR ART)
FIG. 4 shows structural details in a conventional floating mass transducer.

First, it will be helpful to consider the structure of a conventional floating mass transducer in greater detail. FIG. 4 shows structural details in a conventional two-coil FMT 400 as described, for example, in U.S. Pat. No. 6,676,592; which is incorporated herein by reference. A cylindrical inertial mass magnet 412 has magnetic poles at either end as shown and is enclosed within a cylindrical housing 402. The cylindrical ends of the housing are sealed by end plates 404. The inside of each end plate 404 have indentations 401 to retain magnet springs 414 that resiliently bias the magnet 412 within the center of the housing 402 as shown in FIG. 4 away from contact with its inner surface. Twin grooves 406 in the outer surface of the housing 402 hold drive coils 410 which are wound in opposite directions and surround the magnetic poles of the magnet 412. Electric current through the drive coils 410 causes magnetic fields that interact with the magnetic fields of the magnet 412. As the current varies, so does the magnetic field of the drive coils 410 which by interaction with the magnetic field of the magnet 412 causes it to move responsively, suspended on the magnet springs 414. This movement of the inertial mass of the magnet 412 is imparted by the magnet springs 414 to the housing 402. The housing 402 is attached one of the ossicles (e.g., the incus by a clip, not shown) and its vibration is thereby coupled to the attached ossicle, driving the oval window membrane of the cochlea to be perceived by the patient as sound.

Embodiments of the present invention are directed to a floating mass transducer for a hearing implant similar to the foregoing, but with a novel transducer magnet arrangement having magnetic pairs with opposing magnetic fields that cancel each other to minimize the total magnetic field and thereby minimizing magnetic interaction of the transducer magnet arrangement as a whole with external magnetic fields such as from MRIs.

Figure 5A:
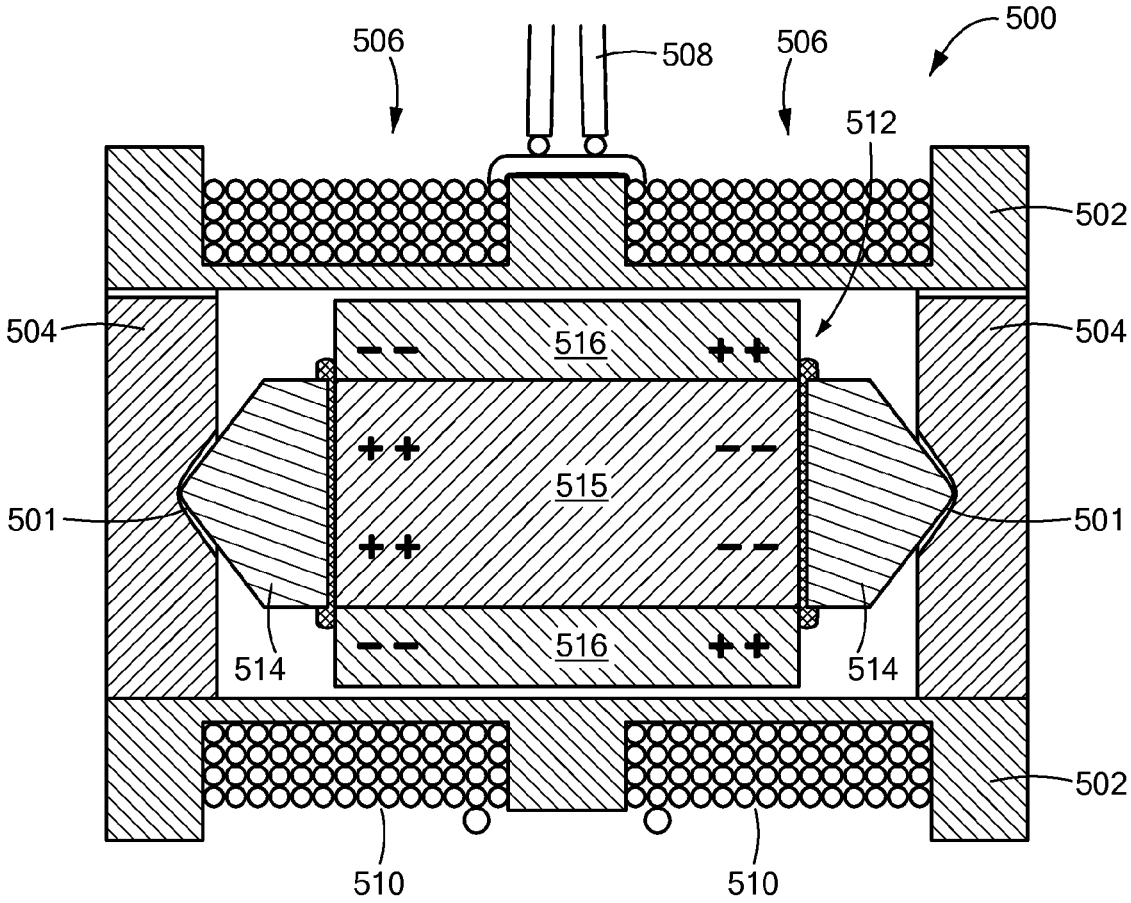
FIG. 5 A-B shows structural details in a floating mass transducer having opposing magnetic pairs according to one embodiment of the present invention.
Figure 5B:
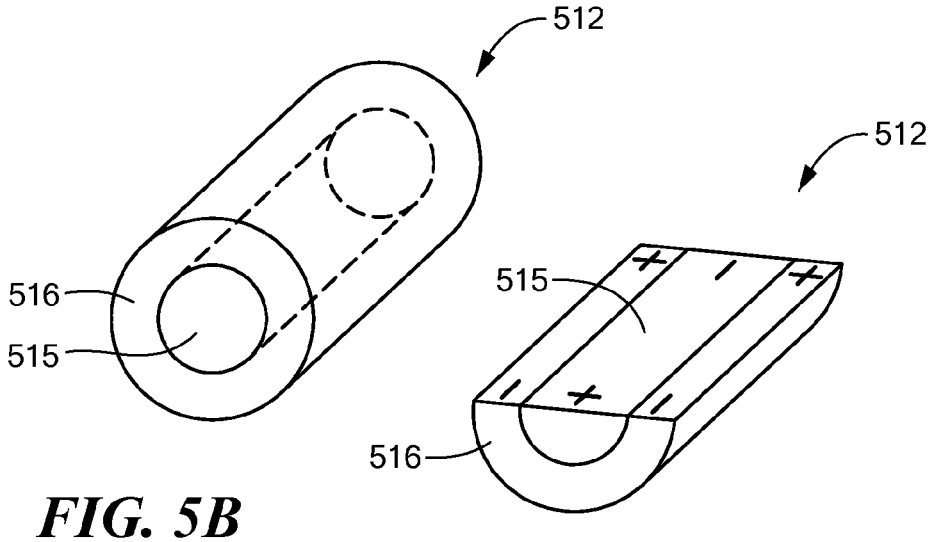

For example, FIG. 5 A-B shows structural details in a floating mass transducer 500 having opposing magnetic pairs 512 according to one embodiment of the present invention. A cylindrical transducer housing 502 enclosed by cylinder end caps 504 is attachable to a middle ear hearing structure. The outer surface of the transducer housing 502 includes coil grooves 506 that hold electric drive coils 510. Within the interior volume of the transducer housing 502 is a cylindrical transducer magnet arrangement comprising a magnetic pair 512 magnets having opposing magnetic fields. The magnetic pair 512 includes an inner rod magnet 515 disposed along the cylinder axis with a first magnetic field direction. Surrounding that is an outer annular magnet 516 with a second magnetic field direction opposite to the first magnetic field direction. Current flow through the drive coils 510 creates a coil magnetic field that interacts with the magnetic fields of the transducer magnet arrangement magnetic pair 512 to create vibration in the magnetic pair 512 which is coupled by magnet springs 514 to the transducer housing 502 and thereby to the middle ear hearing structure for perception as sound. In addition, the opposing magnetic fields of the transducer magnet arrangement magnetic pair 512 cancel each other to minimize their combined magnetic field and thereby minimize magnetic interaction of the transducer magnet arrangement with any external magnetic field.

The embodiment in FIG. 5 A-B is based on a single magnetic pair and two drive coils, but other embodiments of the present invention can use different arrangements. For example, FIG. 6 A-B shows structural details in a floating mass transducer 600 having two opposing magnetic pairs 612 and three drive coils 610. In this embodiment, the magnetic pairs 612 are positioned end to end with like magnetic polarities that repel each other so that they have to be mechanically held against each other where they meet. There are various ways to do this, for example, in addition to suspending the transducer magnet arrangement of magnetic pairs 612 within the transducer housing 602 and transferring vibration of the transducer magnet arrangement to the transducer housing 602, the magnet springs 614 may also be enough to mechanically hold the magnetic pairs 612 against each other. In addition or alternatively, there may be a magnet holding tube 617 that contains the magnetic pairs 612 and mechanically holds them against each other. Or an adhesive may be useful to hold the magnetic pairs 612 against each other.

Figure 6A:
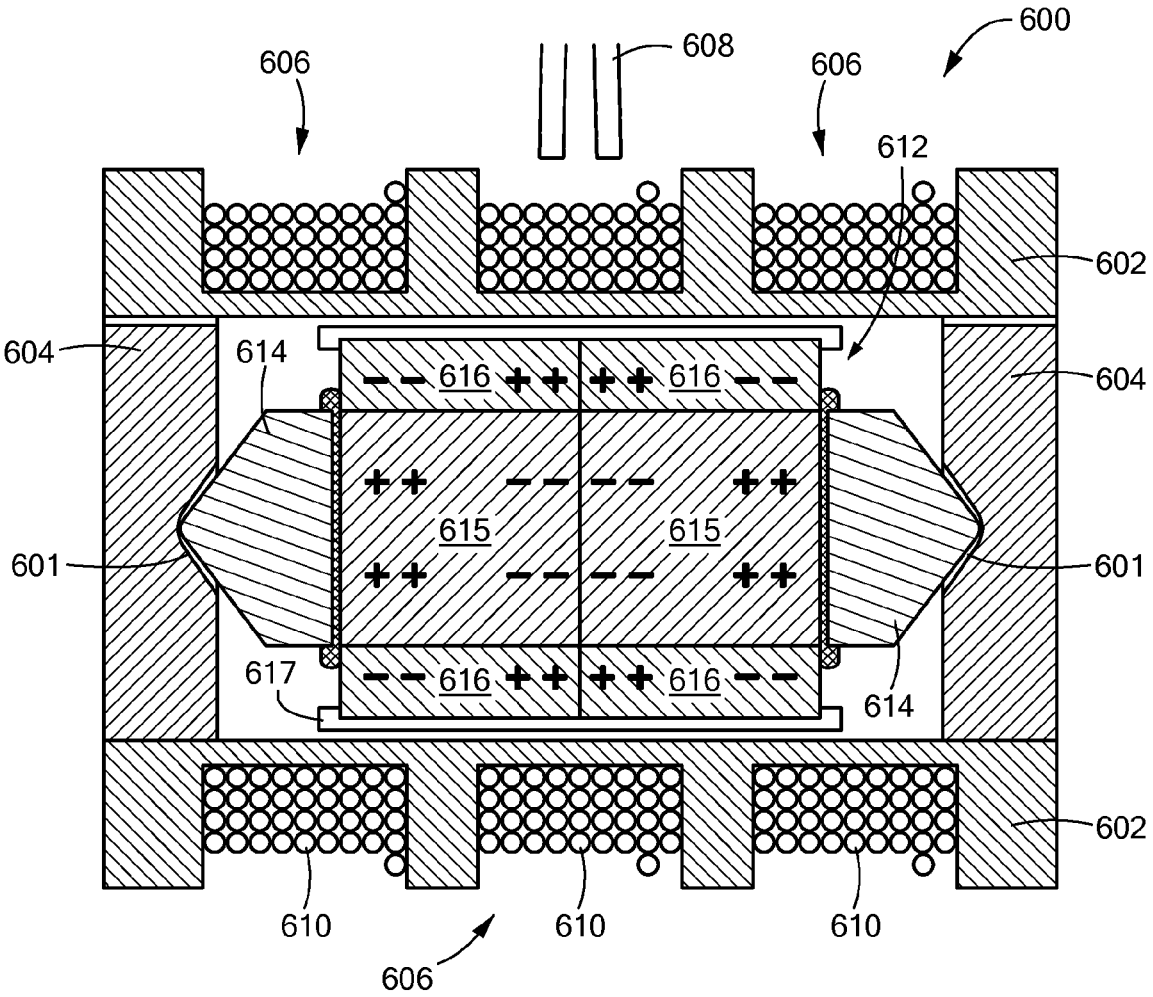
FIG. 6 A-B shows structural details in a floating mass transducer having multiple opposing magnetic pairs according to one embodiment of the present invention.
Figure 6B:
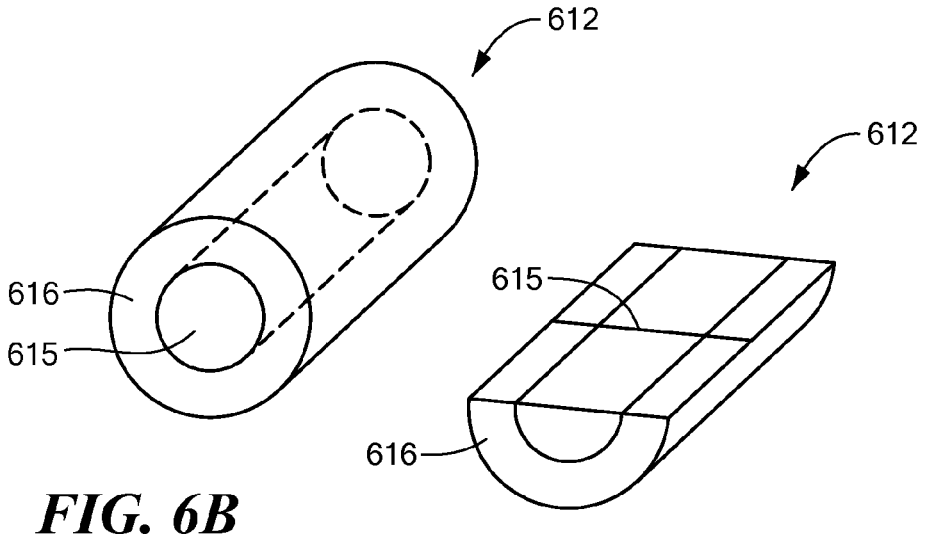
Figure 7:
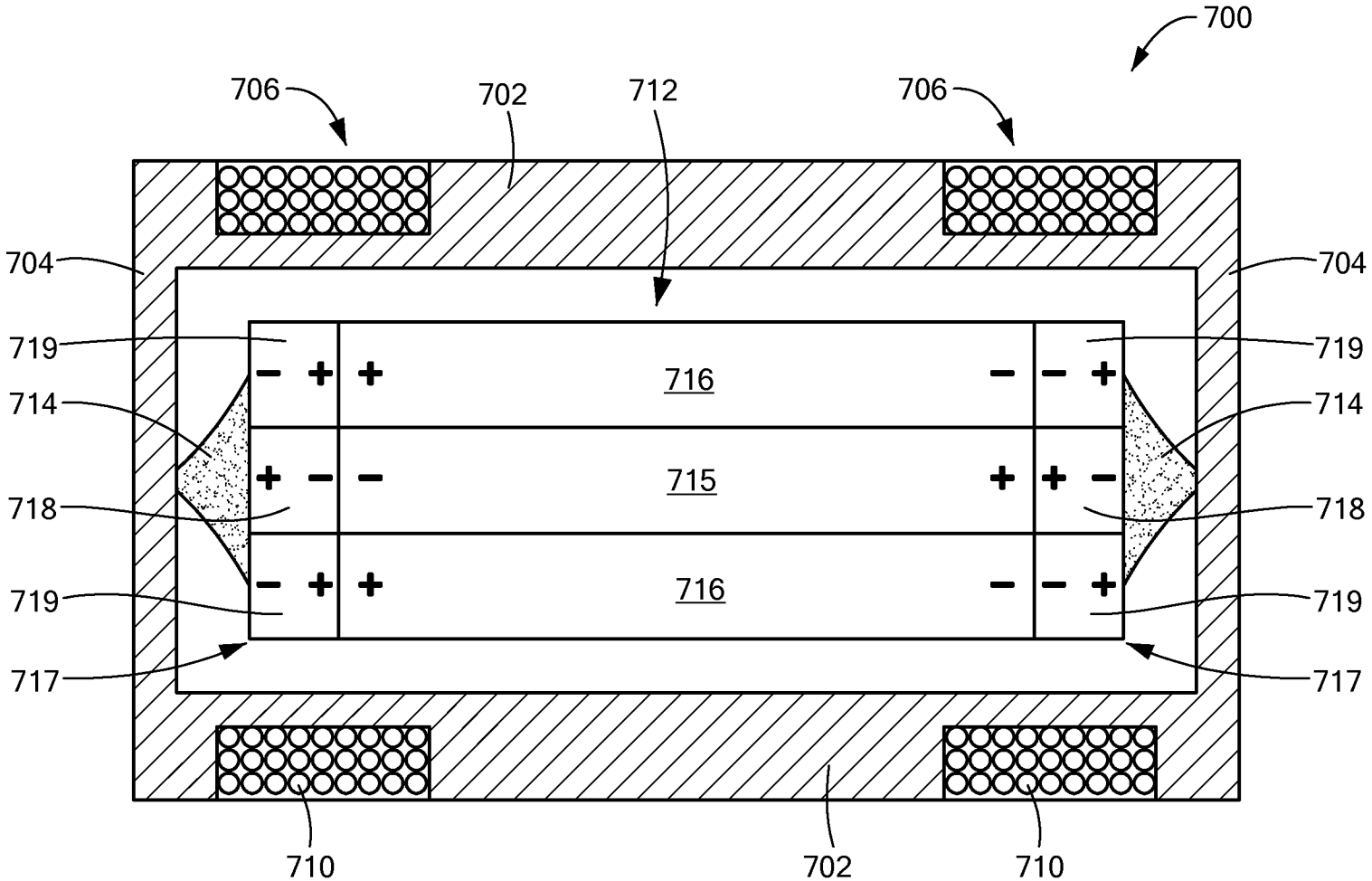
FIG. 7 shows structural details in another embodiment of floating mass transducer having multiple opposing magnetic pairs.

In embodiments such as the one shown in FIG. 6 where the magnetic pairs 612 are positioned end to end with like magnetic polarities that repel each other, the magnetic flux lines of the magnetic pairs are forced into the center drive coil 610 while at the same time limiting the ability of external magnetic forces (i.e., MRI) on the transducer 600. Also, in some embodiments, the seam where the magnetic pairs 612 meet may not necessarily be centered within the transducer housing 602 or aligned directly underneath one of the drive coils 610. For example, FIG. 7 shows an embodiment with a single large center magnetic pair 712 centered within the transducer housing 702 enclosed between smaller end cap magnetic pairs 717 which provide the opposing canceling magnetic fields that still minimize the magnetic torque effects of an external magnetic field such as from an MRI.

Although various exemplary embodiments of the invention have been disclosed, it should be apparent to those skilled in the art that various changes and modifications can be made which will achieve some of the advantages of the invention without departing from the true scope of the invention.

What is claimed is:

1. A floating mass transducer for a hearing implant comprising:

a cylindrical transducer housing attachable to a middle ear hearing structure and having a cylinder axis and an outer surface with one or more electric drive coils thereon;

a cylindrical transducer magnet arrangement positioned within an interior volume of the transducer housing and including a magnetic pair of:

i. an inner rod magnet disposed along the cylinder axis and having a first magnetic field direction, and ii. an outer annular magnet surrounding the inner rod magnet along the cylinder axis and having a second magnetic field direction opposite to the first magnetic field direction;

wherein the inner rod magnet and the outer annular magnet each comprise a pair of magnets positioned mechanically held against each other end to end with like magnetic polarities meeting;

wherein current flow through the drive coils creates a coil magnetic field that interacts with the magnetic fields of the transducer magnet arrangement to create vibration in the transducer magnet which is coupled by the transducer housing to the middle ear hearing structure for perception as sound; and wherein the opposing magnetic fields of the transducer magnet arrangement cancel each other to minimize their combined magnetic field and thereby minimize magnetic interaction of the transducer magnet arrangement with any external magnetic field.

2. A floating mass transducer according to claim 1, further comprising:

a magnet adhesive mechanically holding the plurality of magnetic pairs against each other.

3. A floating mass transducer according to claim 1, further comprising:

a magnet holding tube containing pair of magnets and mechanically holding them against each other.

4. A floating mass transducer according to claim 1, further comprising:

a pair of magnet springs, one at each end of the transducer magnet arrangement to:

i. mechanically hold the plurality of magnetic pairs against each other, ii. suspend the transducer magnet arrangement within the transducer housing, and iii. transfer vibration of the transducer magnet arrangement to the transducer housing.

5. A floating mass transducer according to claim 1, wherein the plurality of magnetic pairs meet with opposing magnetic polarities that attract each other to magnetically hold the plurality of magnetic pairs against each other.

6. A floating mass transducer according to claim 1, wherein there are a plurality of electric drive coils.

* * * * *